US005568529A

United States Patent [19]

Masuda

[11] Patent Number: 5,568,529

[45] Date of Patent: Oct. 22, 1996

[54] SIGNAL DISCONNECTION MONITOR APPARATUS AND SIGNAL PERIOD DETECTION APPARATUS THEREFOR

[75] Inventor: Hitoshi Masuda, Tokyo, Japan

[73] Assignee: NEC Corporation, Tokyo, Japan

[21] Appl. No.: 506,966

[22] Filed: Jul. 28, 1995

[30] Foreign Application Priority Data

Jul. 29, 1994 [JP] Japan ..... 6-178732

[51] Int. Cl.[6] ..... G07C 3/02

[52] U.S. Cl. ..... 377/16; 377/39; 327/292

[58] Field of Search ..... 377/16, 39; 327/292

[56] References Cited

U.S. PATENT DOCUMENTS

| | | | |
|---|---|---|---|
| 4,308,472 | 12/1981 | McLaughlin | 327/292 |
| 4,691,126 | 9/1987 | Splett et al. | 327/292 |
| 5,276,844 | 1/1994 | Aebi et al. | 377/16 |
| 5,287,010 | 2/1994 | Hagiwara | 327/292 |
| 5,301,171 | 4/1994 | Blow et al. | 327/292 |
| 5,345,489 | 9/1994 | Saitoh | 377/39 |
| 5,410,581 | 4/1995 | Hollenbeck et al. | 377/16 |

FOREIGN PATENT DOCUMENTS 3-267833 11/1991 Japan .

*Primary Examiner*—Margaret Rose Wambach

*Attorney, Agent, or Firm*—Sughrue, Mion, Zinn, Macpeak & Seas

[57] ABSTRACT

A signal disconnection detection apparatus includes a first counter, a first comparator, and a detector. The first counter is reset by a pulse signal received every predetermined period of a clock signal, and counts a clock signal transmitted together with data. The first comparator compares a count value of the first counter with a set value larger than the number of clock signals included in one period of the pulse signal, and stops an operation of the first counter when the count value of the first counter exceeds the set value. The detector detects that the count value of the first counter does not continuously change within a predetermined period of time to output a signal disconnection detection signal of at least one of the clock signal and the pulse signal.

10 Claims, 3 Drawing Sheets

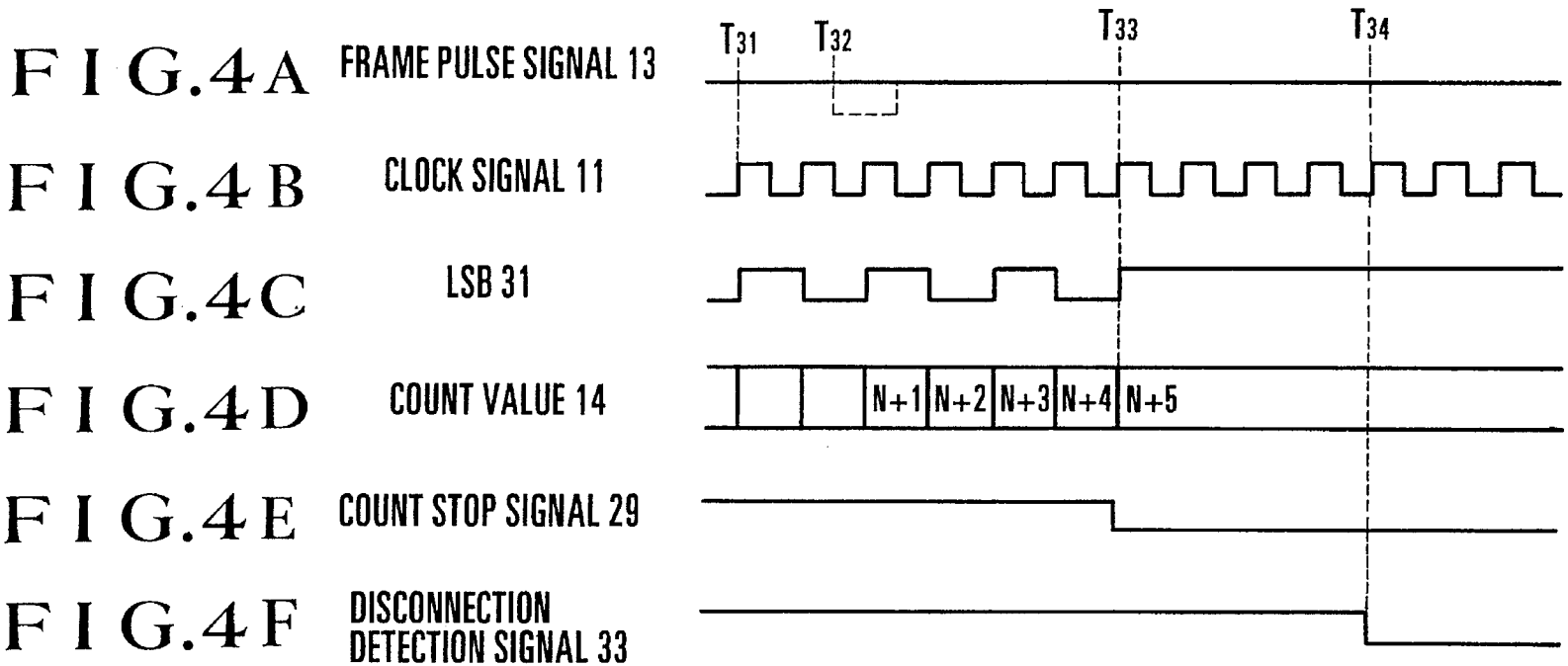
FIG.4A FRAME PULSE SIGNAL 13
FIG.4B CLOCK SIGNAL 11
FIG.4C LSB 31
FIG.4D COUNT VALUE 14
FIG.4E COUNT STOP SIGNAL 29
FIG.4F DISCONNECTION DETECTION SIGNAL 33
T31
T32
T33
T34
N+1
N+2
N+3
N+4
N+5
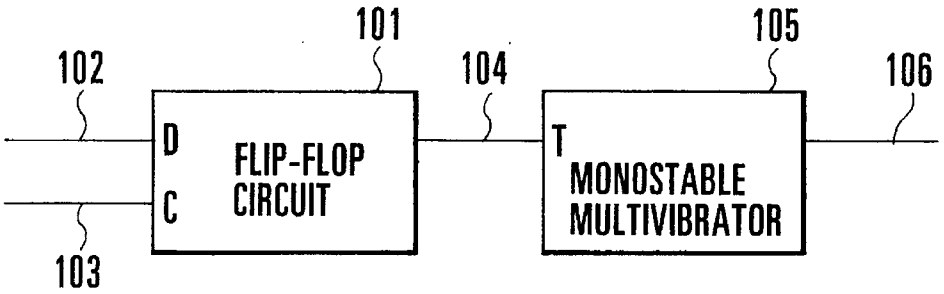
FIG.5
101
FLIP-FLOP CIRCUIT
D
C
102
103
104
105
MONOSTABLE MULTIVIBRATOR
T
106

SIGNAL DISCONNECTION MONITOR APPARATUS AND SIGNAL PERIOD DETECTION APPARATUS THEREFOR

BACKGROUND OF THE INVENTION

The present invention relates to a signal disconnection monitor apparatus for detecting disconnection of a signal and, more particularly, to a signal disconnection monitor apparatus for detecting disconnection of a signal which is received at a specific period.

In synchronous data transmission, a transmission side transmits a clock signal together with data, and a reception side receives the transmitted data in synchronization with the clock signal. In order to cause the reception side to know the start timing of the data, a frame pulse signal is transmitted together with the clock signal. The reception side is designed to recognize the time at which the frame pulse signal is received as the start timing of the data. For example, when data is to be transmitted such that one frame is constituted by 1,024 bits, the frame pulse signal is periodically transmitted once every 1,024 periods of the clock signal. In the above synchronous data transmission, when any one of the clock signal and the frame pulse signal is disconnected, normal communication cannot be performed. For this reason, when a signal disconnection monitor circuit for detecting disconnection of these signals is arranged, and disconnection of a signal in a transmission system is detected, the transmission system is switched to a spare transmission system which is prepared in advance.

FIG. 5 shows the schematic arrangement of a conventional signal disconnection monitor circuit. A frame pulse signal 102 is input to a data input terminal D of a flip-flop circuit 101, and a clock signal 103 is input to a clock terminal C. An output from the flip-flop circuit 101 is input to a monostable multivibrator 105 as a trigger signal 104. An external capacitor (not shown) and an external resistor (not shown) are connected to the monostable multivibrator 105. The monostable multivibrator 105 is designed to output a pulse-like signal 106 for only a time corresponding to a time constant defined by the external resistor and capacitor when the trigger signal 104 is input to the monostable multivibrator 105. When the trigger signal 104 is periodically input at an interval shorter than the time constant, the monostable multivibrator 105 is retriggered to output the continuous signal 106.

The time constant of the signal disconnection monitor circuit is set to be longer than a time corresponding to the period of the frame pulse signal 102. The trigger signal 104 obtained by sampling the value of the frame pulse signal 102 is input to a trigger terminal T of the monostable multivibrator 105 in synchronism with rising of the clock signal 103. Therefore, when both the clock signal 103 and the frame pulse signal 102 are normally received, the trigger signal 104 is input at a time interval shorter than the time constant, and the continuous signal 106 is output from the monostable multivibrator 105.

When the frame pulse signal 102 is disconnected, an output from the flip-flop circuit 101 does not change, and the monostable multivibrator 105 is not triggered. In addition, when the clock signal 103 is disconnected, the output from the flip-flop circuit 101 does not change, and the monostable multivibrator 105 is not triggered. When the trigger signal 104 is not input to the monostable multivibrator 105, the monostable multivibrator 105 stops outputting the signal 106 at time when a time corresponding to the time constant has elapsed from time at which monostable multivibrator 105 is triggered by the last trigger signal. Therefore, when the output 106 from the monostable multivibrator 105 is used as a disconnection detection signal, and the disconnection detection signal is monitored, it can be detected that any one of the frame pulse signal 102 and the clock signal 103 is disconnected.

A signal disconnection monitor circuit for causing a digital circuit to detect disconnection of a frame pulse signal is also known. According to the signal disconnection monitor circuit using a digital scheme, a counter counts a clock signal, and the count value of the counter is reset every time a frame pulse signal is received. The count value of the counter is compared with a predetermined value larger than a maximum value which can be counted within the period of the frame pulse signal. When the frame pulse signal is disconnected, the counter is not reset. For this reason, the count value of the counter exceeds the predetermined value. Such a signal disconnection monitor circuit is disclosed in Japanese Patent Laid-Open No. 3-267833.

In the signal disconnection monitor circuit shown in FIG. 5, the time constant of the monostable multivibrator 105 is set depending on the period of the frame pulse signal 102. For example, when the period of the frame pulse signal 102 corresponds to the length of 1,000 periods of the clock signal 103, the time constant of the monostable multivibrator 105 is set to be larger than the length corresponding to 1,000 periods of the clock signal 103. For this reason, when the clock signal 103 is disconnected immediately after the frame pulse signal 102 is received, a time almost equal to the predetermined time constant is required to detect disconnection of the clock signal 103. When a long time is required to detect disconnection of the clock signal 103 as described above, a switching operation to a spare transmission system is delayed. After the clock signal 103 is disconnected, a long time is disadvantageously required to perform restoration to a normal communication state.

In order to avoid this, a signal disconnection monitor circuit for independently detecting disconnection of a frame pulse signal and disconnection of a clock signal is also known. In this circuit, a clock signal is input as a trigger signal, and a monostable multivibrator for detecting disconnection of the clock signal is separately arranged, and the time constant of the monostable multivibrator is set to be a short time corresponding to several periods of the clock signal. However, when the monostable multivibrator is separately arranged, registers and capacitors to be externally arranged increase in number, and the signal disconnection monitor circuit cannot be easily made as an integrated circuit. As a result, the signal disconnection monitor circuit cannot be easily decreased in cost and size.

In the signal disconnection monitor circuit disclosed in Japanese Patent Laid-Open No. 3-267833, when a clock signal is disconnected, a count operation is not performed. For this reason, disconnection of a frame pulse signal cannot be detected. Disconnection of the clock signal cannot be detected either. Therefore, in this signal disconnection monitor circuit, a circuit for detecting the disconnection of the clock signal must be separately arranged, and the arrangement of the signal disconnection monitor circuit is disadvantageously complicated.

In the signal disconnection monitor circuit shown in FIG. 5, the values of the external capacitors and resistors connected to the monostable multivibrator must be optimally set in accordance with the period of the frame pulse signal. This is because when a time constant is set to be larger than a necessary time constant, a time required for detecting disconnection is prolonged, and restoration to a normal communication state is more delayed. For this reason, external parts must be changed in accordance with each communication state, i.e., the period of the frame pulse signal, and this operation is disadvantageously complex. For a similar reason, in the signal disconnection monitor circuit disclosed in Japanese Patent Laid-Open No. 3-267833, a value to be compared with the count value of the counter must be set in advance in accordance with the period of the frame pulse. This operation is disadvantageously complex.

SUMMARY OF THE INVENTION

It is the first object of the present invention to provide a signal disconnection monitor apparatus capable of detecting disconnection of a clock signal and disconnection of a frame pulse signal within proper disconnection detection times, respectively.

It is the second object of the present invention to provide a signal disconnection monitor apparatus capable of detecting disconnection of a frame pulse signal having an arbitrary period.

In order to achieve the above objects, according to the present invention, there is provided a signal disconnection detection apparatus comprising first count means, reset by a pulse signal received every predetermined period of a clock signal, for counting a clock signal transmitted together with data, first comparison means for comparing a count value of the first count means with a set value larger than the number of clock signals included in one period of the pulse signal, and stopping an operation of the first count means when the count value of the first count means exceeds the set value, and detection means for detecting that the count value of the first count means does not continuously change within a predetermined period of time to output a signal disconnection detection signal of at least one of the clock signal and the pulse signal.

BRIEF DESCRIPTION OF THE DRAWINGS

FIGS. 4A to 4F are waveform charts showing the waveforms of the portions of the signal disconnection monitor circuit shown in FIG. 1 when the frame pulse signal is disconnected; and FIG. 5 is a block diagram showing the schematic arrangement of a conventional signal disconnection monitor circuit.

DESCRIPTION OF THE PREFERRED EMBODIMENT

The present invention will be described below with reference to an embodiment.

Figure 1:
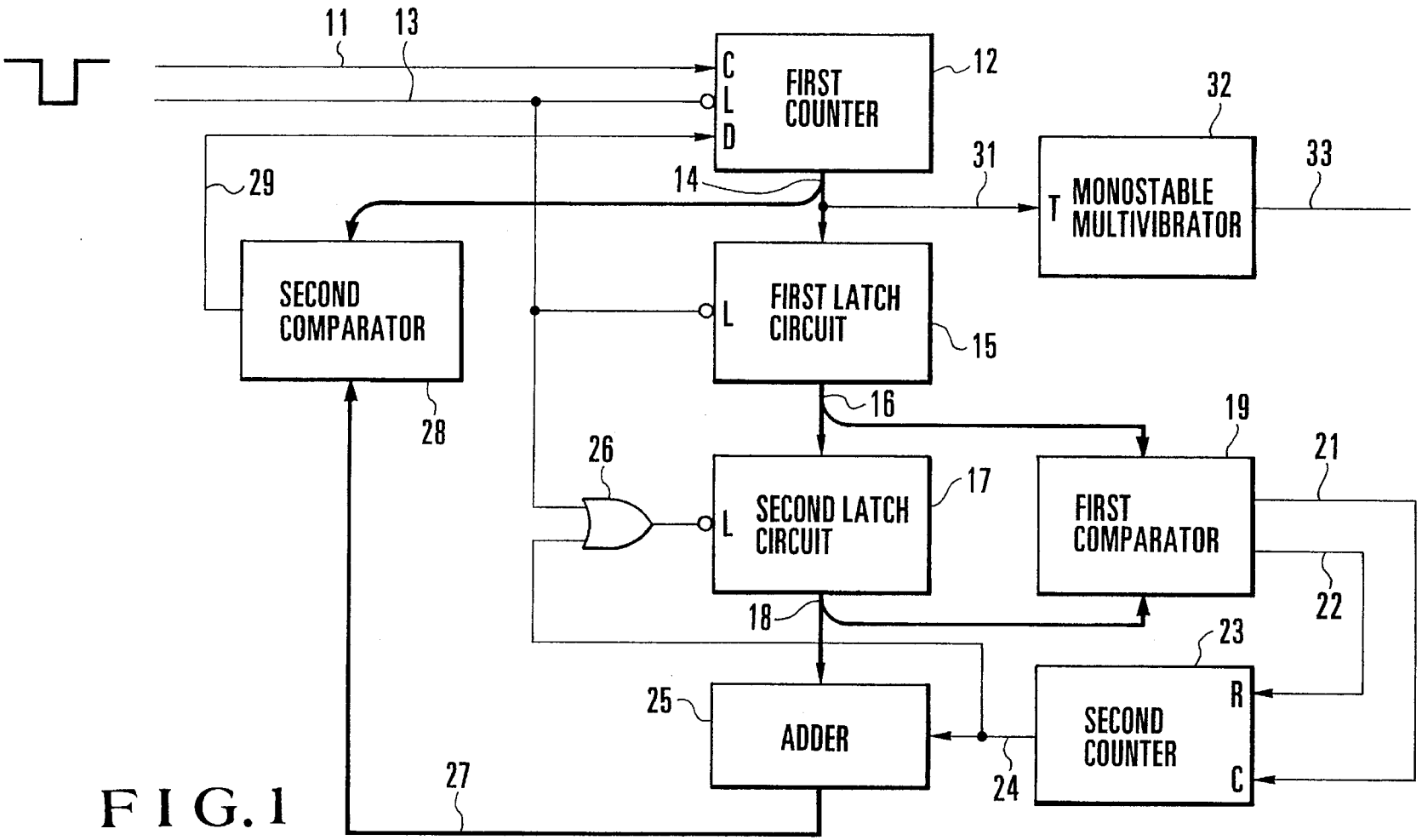
FIG. 1 is a block diagram showing the schematic arrangement of a signal disconnection monitor circuit according to an embodiment of the present invention.

FIG. 1 shows the schematic arrangement of a signal disconnection monitor circuit according to an embodiment of the present invention. The signal disconnection circuit comprises a first counter 12 for counting a clock signal 11 input to a clock terminal C. A frame pulse signal 13 serving as a load signal is input to a load terminal L of the first counter 12. When the frame pulse signal 13 is received by the first counter 12, "0" is loaded as an initial value in the first counter 12. The first counter 12 can count pulses up to $2^{10}$, and the first counter 12 is designed to output the count value as a 10-bit digital signal 14. The digital signal 14 representing the count value of the first counter 12 is input to a first latch circuit 15. When the frame pulse signal 13 is received by the first counter 12 and input to the load terminal L, the first latch circuit 15 can hold the count value of the first counter 12. The value of a digital signal 16 output from the first latch circuit 15 is designed to be held by a second latch circuit 17. When the frame pulse signal 13 is received by the first counter 12, the second latch circuit 17 can hold the output 16 from the first latch circuit 15. In this manner, the first latch circuit 15 holds a count value of the first counter 12 obtained when the current frame pulse signal 13 is received by the first counter 12. The second latch circuit 17 holds a count value obtained when the previous frame pulse signal 13 is received by the first counter 12. These values are sequentially updated every time the frame pulse signal 13 is received by the first counter 12.

The output 16 from the first latch circuit 15 and an output 18 from the second latch circuit 17 are input to a first comparator 19. When the values of the two input signals 16 and 18 coincide with each other, the first comparator 19 outputs a coincidence signal 21 representing that the values coincide with each other. On the other hand, when these values do not coincide with each other, the first comparator 19 outputs a non-coincidence signal 22 representing that the values do not coincide with each other. A second counter 23 is designed to increment the count by one when the coincidence signal 21 from the first comparator 19 is input to the clock terminal C, and the second counter 23 is designed to reset the count value of the second counter 23 when the non-coincidence signal 22 is input to a reset terminal R. After the second counter 23 counts pulses up to "10", the second counter 23 stops the count operation to continuously output a count end signal 24. When the count end signal 24 from the second counter 23 is input to an adder 25, the adder 25 adds a predetermined value ("5", in this case) to the value held by the second latch circuit 17.

An OR circuit 26 is connected to a load terminal L of the second latch circuit 17. The frame pulse signal 13 and the count end signal 24 are input to the OR circuit 26. The frame pulse signal 13 is a negative logic signal, and goes to "0" only when the signal is received by the OR circuit 26. On the other hand, the count end signal 24 is a positive logic signal, and goes to "1" when the second counter 23 counts pulses up to "10". Therefore, after the count end signal 24 is output, the gate of the OR circuit 26 functioning as a gate circuit is closed, and the value held by the second latch circuit 17 is not updated even when the frame pulse signal 13 is received by the 0R circuit 26. In this manner, the second latch circuit 17 is designed to hold a count value obtained when values continuously coincide with each other ten times after the count end signal 24 is output. More specifically, the second latch circuit 17 holds the number of pulses of the clock signal 11 corresponding to the period of the frame pulse signal 13. The adder 25 adds "5" to the value held by the second latch circuit 17 by inputting the count end signal 24 to the adder 25, and outputs the resultant value. For this reason, the value output from the adder 25 is a value corresponding to a time which is longer than the period of the frame pulse signal 13 by 5 clocks.

An output 27 from the adder 25 and the output 14 from the first counter 12 are input to a second comparator 28. When the count value 14 of the first counter 12 exceeds the output value 27 from the adder 25, the second comparator 28 outputs a count stop signal 29. After the count stop signal 29 from the second comparator 28 is input to a disable terminal D, the first counter 12 stops the count operation for the clock signal 11. However, when the frame pulse signal 13 and the count stop signal 29 are simultaneously input, priority is given to the frame pulse signal 13 to prevent the count operation from being stopped. A signal 31 corresponding to the LSB (Least Significant Bit) of the output 14 from the first counter 12 is input to a monostable multivibrator 32 as a trigger signal. When the LSB of the output 14 from the first counter 12 changes from "0" to "1", the monostable multivibrator 32 is triggered. The time constant of the monostable multivibrator 32 is set such that the monostable multivibrator 32 outputs a disconnection detection signal 33 for a time corresponding to four periods of the clock signal 11 from time when the trigger signal 31 is input to a trigger terminal T.

An operation of the signal disconnection monitor circuit having the above arrangement will be described below. First, an operation performed until the signal disconnection monitor circuit detects the period of the frame pulse signal 13 will be described below.

When the frame pulse signal 13 is received by the first counter 12, the count value of the first counter 12 is reset to "0". Thereafter, the first counter 12 starts a count-up operation from "0" on the basis of the clock signal 11. When the next frame pulse signal 13 is received by the first counter 12, the count value of the first counter 12 is held by the first latch circuit 15. At this time, assume that the count value is "1000". The first counter 12 is reset again by receiving the frame pulse signal 13, and the count value returns to "0". If the period of the frame pulse signal 13 is constant, the count value of the first counter 12 becomes "1000" when the next frame pulse signal 13 is received by the first counter 12. This value is held by the first latch circuit 15. At the same time, the second latch circuit 17 holds the value which has been held by the first latch circuit 15. In this manner, the count value of the first counter 12 obtained when the frame pulse signal 13 is received by the first counter 12 at this time is held by the first latch circuit 15, and the previous count value is held by the second latch circuit 17.

The first comparator 19 compares the value held by the first latch circuit 15 with the value held by the second latch circuit 17 every time the frame pulse signal 13 is received by the first counter 12. When these values coincide with each other, i.e., when the period of the frame pulse signal 13 at the last time coincides with the period at this time, the first comparator 19 outputs the coincidence signal 21. The second counter 23 counts up the coincidence signal 21. When the period of the frame pulse signal 13 at the last time is different from the period at this time, the values respectively held by the first latch circuit 15 and the second latch circuit 17 do not coincide with each other, and the first comparator 19 outputs the non-coincidence signal 22. The second counter 23 is reset by the non-coincidence signal 22. When the second counter 23 counts pulses up to "10", i.e., when the period of the frame pulse signal 13 does not change within 10 periods, the second counter 23 stops a count operation to output the count end signal 24.

After the count end signal 24 is output from the second counter 23, if the frame pulse signal 13 is received by the first counter 12, the OR circuit 26 prevents the second latch circuit 17 from reloading a value output from the first latch circuit 15, and the count value obtained when the values continuously coincide with each other ten times is held by the second latch circuit 17 subsequently. In this manner, the count value obtained when the values continuously coincide with each other ten times is detected by the signal disconnection monitor circuit as a value representing the period of the frame pulse signal 13. The adder 25 outputs a value obtained by adding "5" to a value held by the second latch circuit 17 by inputting the count end signal 24 to the adder 25. A disconnection detection time can be arbitrarily set by selecting a value to be added.

An operation of the signal disconnection monitor circuit when a clock signal and a frame pulse signal are normally received will be described below.

Figures 2A, 2B, 2C, 2D, 2E, 3A, 3B, 3C, 3D, 3E:
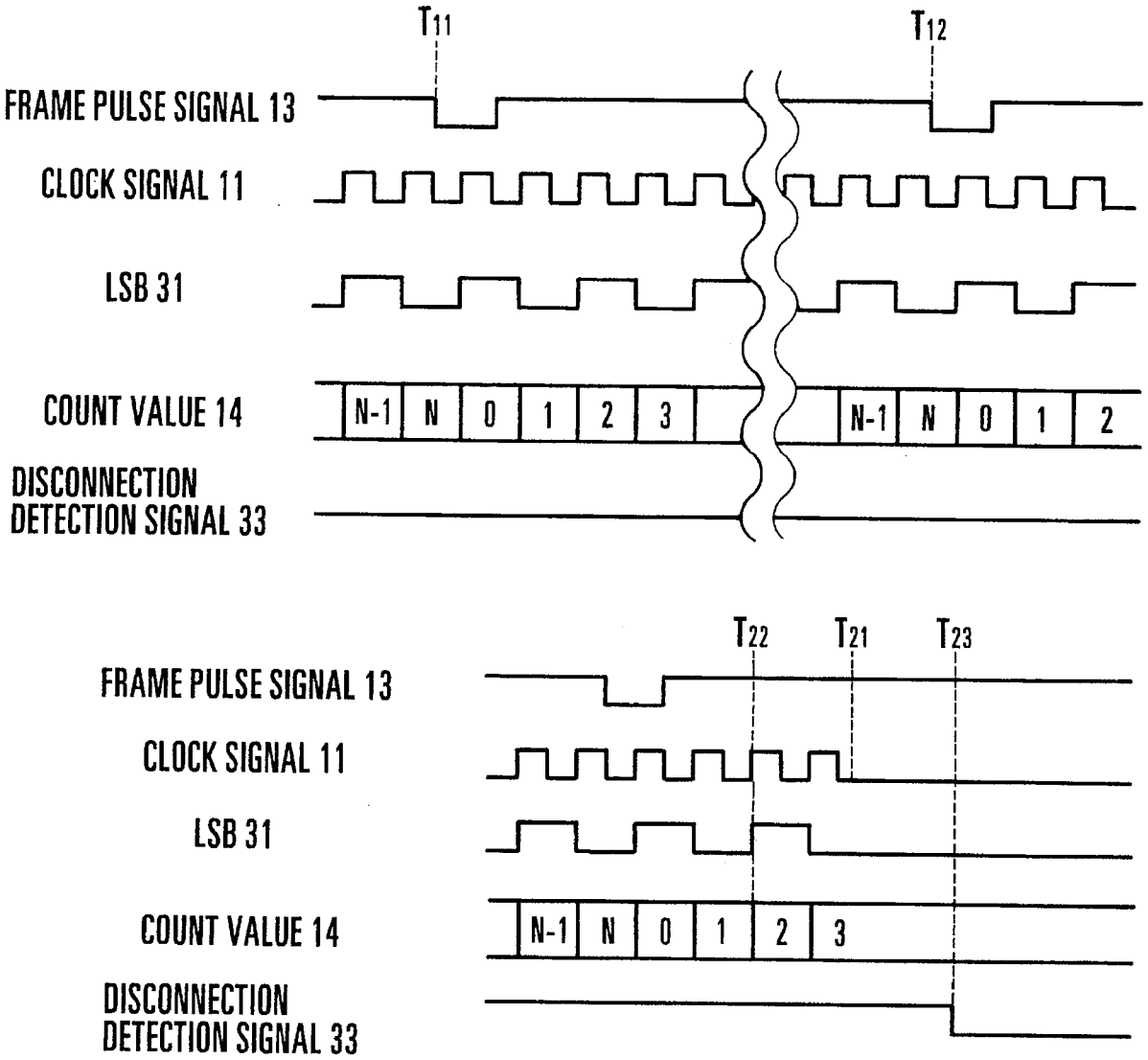
FIGS. 2A to 2E are waveform charts showing the waveforms of portions of the signal disconnection monitor circuit shown in FIG. 1 when a frame pulse signal and a clock signal are normally received.
FIGS. 3A to 3E are waveform charts showing the waveforms of the portions of the signal disconnection monitor circuit shown in FIG. 1 when the clock signal is disconnected.

FIGS. 2A to 2E show the waveforms of portions of the signal disconnection monitor circuit when the clock signal and the frame pulse signal are normally received. The clock signal 11 (FIG. 2B) is continuously received, and the first counter 12 counts the clock signal 11. At time (time $T_{11}$) when the frame pulse signal 13 (FIG. 2A) is received by the first counter 12, the first counter 12 is reset, and the count value 14 (FIG. 2D) of the first counter 12 goes to "0". It is assumed that the period of the frame pulse signal 13 corresponds to 1,000 periods of the clock signal 11. Therefore, the count value obtained when the frame pulse signal 13 is received is set to be "1000". In FIG. 2D, "N" represents "1000". When the next frame pulse signal 13 is received at time $T_{12}$, the first counter 12 is reset again. For this reason, the count value of the first counter 12 does not exceed "1000". Since an output from the adder 25 is set to be "1005, the count stop signal 29 is not output from the second comparator 28. As a result, the first counter 12 repeatedly counts pulses up to "1000".

The signal 31 (FIG. 2C) corresponding to the LSB of the digital signal 14 representing the count value of the first counter 12 is a signal having a period ½ the period of the clock signal 11. This signal 31 is input as a trigger signal for the monostable multivibrator 32, and the monostable multivibrator 32 outputs a signal 33 having a length corresponding to four periods of the clock signal 11 is output every time the monostable multivibrator 32 is triggered. Therefore, while the first counter 12 performs a count operation, the disconnection detection signal 33 (FIG. 2E) is continuously output from the monostable multivibrator 32. As described above, when the clock signal 11 and the frame pulse signal 13 are normally received, the first counter 12 continuously performs a count operation. For this reason, the disconnection detection signal 33 having a value of "1" is continuously output from the monostable multivibrator 32.

An operation of the signal disconnection monitor circuit when a clock signal is disconnected will be described below with reference to FIGS. 3A to 3E.

FIGS. 3A to 3E show the waveforms of portions of the signal disconnection monitor circuit when a clock signal is disconnected. When the clock signal 11 (FIG. 3B) is disconnected at time $T_{21}$, the first counter 12 does not continue any count-up operation thereafter. For this reason, the value 31 (FIG. 3C) of the LSB no longer changes, and no trigger signal is input to the monostable multivibrator 32. Therefore, the disconnection detection signal 33 (FIG. 3E) serving as an output from the monostable multivibrator 32 changes from "1" to "0" at time ($T_{23}$) when a time corresponding to four clocks has elapsed from time ($T_{22}$) when the last trigger signal is input. In this manner, the value of the disconnection detection signal 33 changes within a time corresponding to four clocks after the clock signal 11 is disconnected, and disconnection of the clock signal 11 can be detected within a short time. FIG. 3A shows the frame pulse signal 13, and FIG. 3D shows the count value 14 of the first counter 12.

Finally, an operation of the signal disconnection monitor circuit when the frame pulse signal is disconnected will be described below with reference to FIGS. 4A to 4F.

FIGS. 4A to 4F show the waveforms of the portions of the signal disconnection monitor circuit when the frame pulse signal is disconnected. Assume that the frame pulse signal 13 (FIG. 4A) is disconnected at time $T_{31}$. In this case, the frame pulse signal 13 is not received at time ($T_{32}$) when the first counter 12 continuously counts pulses up to "1000". For this reason, the first counter 12 is not reset, and the first counter 12 continuously counts pulses over "1000" after time $T_{32}$. When the count value 14 (FIG. 4D) of the first counter 12 reaches "1005" (time $T_{33}$), the second comparator 28 outputs the count stop signal 29 (FIG. 4E). Referring to FIG. 4E, the count stop signal 29 changes from "1" to "0" at time $T_{33}$. For this reason, the first counter 12 stops a count operation after time $T_{33}$. When the count operation is stopped, the value 31 (FIG. 4C) of the LSB does not change, and a trigger signal is no longer input to the monostable multivibrator 32. Therefore, the disconnection detection signal 33 (FIG. 4F) output from the monostable multivibrator 32 changes from "1" to "0" at time ($T_{34}$) when a time corresponding to four clocks has elapsed from time $T_{33}$.

As described above, when the frame pulse signal 13 is disconnected, the first counter 12 does not reset thereafter. For this reason, the count value exceeds a predetermined value, and the count operation is stopped. When the count operation is stopped, no trigger signal is input to the monostable multivibrator 32, and disconnection of the frame pulse signal 13 can be detected.

In this manner, since disconnection of the clock signal and the frame pulse signal can be detected by one monostable multivibrator, external parts decrease in number, and the signal disconnection monitor circuit can be easily designed as an integrated circuit. In addition, since the time constant of the monostable multivibrator can be set to be smaller than the period of the frame pulse signal, a time required for detecting disconnection of the clock signal can be shortened.

In the embodiment described above, the period of the frame pulse signal is detected by the signal disconnection monitor circuit. However, when the period of the frame pulse signal has already been known, a value corresponding to the period may be input to the second comparator. In addition, although a count value corresponding to the previous period and a count value corresponding to the current period are held by the first and second latch circuits, the storage means is not limited to the latch circuit.

The adder 25 adds a predetermined value to a value held by the second latch circuit 17, i.e., the clock period of the frame pulse signal, and outputs the resultant value to the second comparator 28. However, the adder 25 may be omitted, the value held by the second latch circuit 17 may be directly output to the second comparator 28. In addition, the second counter has been described above as a counter, having an overflow output function, for outputting a count end signal when the value of the counter reaches a predetermined count value. However, the second counter may be constituted by a counter circuit having no overflow output and a comparator for comparing the count value of the counter circuit with a predetermined value to check whether the count value of the counter circuit reaches the predetermined value.

As has been described above, according to the present invention, a count means for counting a clock signal is initialized every time a pulse signal having a constant repetition period is received, and the count operation of the count means is stopped when the count value exceeds a predetermined value. The count operation is also stopped when the clock signal is disconnected. For this reason, when it is detected that the count value does not change for a predetermined period of time, disconnection of the pulse signal and the clock signal can be detected. Since a predetermined period of time in which it is detected that the count value does not change can be set to be shorter than the period of the pulse signal, disconnection of the clock signal can be detected within a short time. In addition, since the disconnection of the two signals is detected by one counting operation step detection means, the arrangement of the signal disconnection monitor circuit can be simplified, and the circuit can be decreased in cost and size.

The first count means counts the clock signal, and is initialized every time a pulse signal is received. When count values obtained when pulse signals are received continuously coincide with each other a predetermined number of times, the count value is determined as a value corresponding to the repetition period of the pulse signal. Therefore, if the period of the pulse signal changes during a counting operation, a repetition period at stable time can be detected without receiving the change in period.

In addition, the period of a pulse signal which is received is detected, and the disconnection of the pulse signal is detected with reference to the detected period. In this manner, disconnection of a pulse signal having an arbitrary period can be detected without changing the setting of external parts or the circuit, and a general-purpose signal disconnection monitor circuit can be obtained.

Since an adding means adds a predetermined value to a count value corresponding to the period of the detected pulse signal, a time required for detecting the disconnection of the pulse signal can be freely set depending on the addition value.

In addition, the monostable multivibrator is triggered by a signal corresponding to the LSB of a digital signal output from the first count means. Since the time constant of the monostable multivibrator larger than the period of the signal corresponding to the LSB is preferably used, a time required for detecting the disconnection of the clock signal can be shortened. Furthermore, since disconnection of two signals can be detected by one monostable multivibrator, external parts for setting the time constant decrease in number, and the signal disconnection monitor circuit can be designed as an integrated circuit.

What is claimed is:

1. A signal disconnection detection apparatus comprising:

first count means, reset by a pulse signal received every predetermined period of a clock signal, for counting a clock signal transmitted together with data;

first comparison means for comparing a count value of said first count means with a set value larger than the number of clock signals included in one period of the pulse signal, and stopping an operation of said first count means when the count value of said first count means exceeds the set value; and detection means for detecting that the count value of said first count means does not continuously change within a predetermined period of time to output a signal disconnection detection signal of at least one of the clock signal and the pulse signal.

2. An apparatus according to claim 1, further comprising determination means for checking whether the count value of said first count means is kept constant a predetermined number of times, holding means for holding the count value which is determined as the count value kept constant the predetermined number of times as a value representing a period of the pulse signal, and setting means for setting a set value on the basis of the count value held by said holding means, and wherein said first comparison means compares the set value set by said setting means with the count value of said first count means.

3. An apparatus according to claim 2, wherein said determination means comprises:

first storage means for updating and storing the count value of said first count means which has not been reset when the pulse signal is received;

second storage means for updating and storing an immediately preceding stored value of said storage means when said pulse signal is received;

second comparison means for comparing two stored values of said first and second storage means with each other every time the pulse signal is received; and second count means, incremented by one on the basis of a comparison result of said second comparison means when the two stored values of said first and second storage means are equal to each other, and reset when the two stored values are not equal to each other, for outputting a determination signal representing that the count value of said first count means is kept constant a predetermined number of times when an incremented count value reaches a predetermined value, and said holding means comprises one of said first and second storage means, and one of said first and second storage means holds a stored value obtained when the determination signal is output from said second determination means regardless of reception of the pulse signal.

4. An apparatus according to claim 3, further comprising inhibition means for inhibiting a subsequent updating/storing operation of one of said first and second storage means upon reception of the pulse signal when the determination signal is output from said second count means, and wherein said setting means sets a set value on the basis of the stored value of one of said first and second storage means which is inhibited by said inhibition means from the updating/storing operation.

5. An apparatus according to claim 2, wherein said setting means comprises an adder for adding a predetermined value to the count value held by said holding means to set a set value.

6. An apparatus according to claim 1, wherein said first count means comprises a counter for outputting a count value as a digital signal having a plurality of bits, and said detection means comprises a retrigger type monostable multivibrator for inputting, as a trigger signal, a least significant bit signal of the digital signal output from said counter.

7. A signal disconnection detection apparatus comprising:

first count means, reset by a pulse signal received every predetermined period of a clock signal, for counting a clock signal transmitted together with data;

first storage means for updating and storing a count value of said first count means which has not been reset when the pulse signal is received;

second storage means for updating and storing an immediately preceding stored value of said first storage means when the pulse signal is received;

first comparison means for comparing two stored values of said first and second storage means every time the pulse signal is received;

second count means, incremented by one when a comparison value of said first comparison means represents that the two stored values of said first and second storage means are equal to each other, and reset when the two stored values of said first and second storage means are not equal to each other, for outputting a count end signal when the count value reaches a predetermined value;

inhibition means for inhibiting an updating\storing operation of one of said first and second storage means upon reception of the pulse signal to hold the stored value when the count end signal is output from said second count means;

second comparison means for comparing the count value of said first count means with a set value based on the stored value of one of said first and second storage means, and stopping an operation of said first count means when the count value of said first count means exceeds the set value; and detection means for detecting that the count value of said first count means does not continuously change for a predetermined period of time to output a signal disconnection detection signal of at least one of the clock signal and the pulse signal.

8. An apparatus according to claim 7, further comprising addition means for adding a predetermined value to the stored value held by one of said first and second storage means, and wherein said detection means compares the count value of said first count means with the set value from said addition means.

9. An apparatus according to claim 7, wherein said first count means comprises a counter for outputting a count value as a digital signal having a plurality of bits, and said detection means comprises a retrigger type monostable multivibrator for inputting, as a trigger signal, a least significant bit signal of the digital signal output from said counter.

10. A signal period detection apparatus for a signal disconnection monitor apparatus, comprising:

first count means, reset by a pulse signal received every predetermined period of a clock signal, for counting a clock signal transmitted together with data;

first storage means for updating and storing a count value of said first count means which has not been reset when the pulse signal is received;

second storage means for updating and storing an immediately preceding stored value of said first count means when the pulse signal is received;

comparison means for comparing two stored values of said first and second storage means every time the pulse signal is received; and second count means, incremented by one when a comparison value of said comparison means represents that the two stored values of said first and second storage means are equal to each other, and reset when the comparison value represents that the two stored values of said first and second storage means are not equal to each other, for outputting a count end signal when the count value reaches a predetermined value, wherein one of said first and second storage means outputs a stored value of a corresponding one of said first and second storage means as a value representing the period of the pulse signal used for monitoring signal disconnection when a count end signal is output from said second count means.

* * * * *